US009828658B2

(12) United States Patent
Helmink

(10) Patent No.: US 9,828,658 B2
(45) Date of Patent: Nov. 28, 2017

(54) COMPOSITE NIOBIUM-BEARING SUPERALLOYS

(71) Applicant: Rolls-Royce North American Technologies, Inc., Indianapolis, IN (US)

(72) Inventor: Randolph C. Helmink, Avon, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 323 days.

(21) Appl. No.: 14/456,424

(22) Filed: Aug. 11, 2014

(65) Prior Publication Data

US 2016/0215369 A1 Jul. 28, 2016

Related U.S. Application Data

(60) Provisional application No. 61/865,181, filed on Aug. 13, 2013.

(51) Int. Cl.

| | |
|---|---|
| ***C22C 19/00*** | (2006.01) |
| ***C22C 19/05*** | (2006.01) |
| ***C22F 1/10*** | (2006.01) |

(52) U.S. Cl.

CPC ..... *C22C 19/057* (2013.01); *C22C 19/056* (2013.01); *C22F 1/10* (2013.01)

(58) Field of Classification Search

CPC ..... C22C 19/00; C22C 2202/00; C22F 1/10
USPC ..... 148/410
See application file for complete search history.

(56) References Cited

U.S. PATENT DOCUMENTS

| | | | |
|---|---|---|---|
| 3,649,379 | A | 3/1972 | Kotval |
| 3,700,427 | A | 10/1972 | Baker et al. |
| 3,838,981 | A | 10/1974 | Foley et al. |
| 3,890,816 | A | 6/1975 | Allen et al. |
| 3,917,463 | A | 11/1975 | Doi et al. |
| 3,929,467 | A | 12/1975 | Davies et al. |
| 3,985,582 | A | 10/1976 | Bibring et al. |
| 4,012,241 | A | 3/1977 | Lemkey |
| 4,084,161 | A | 4/1978 | Manning |
| 4,439,236 | A | 3/1984 | Ray |
| 4,451,431 | A | 5/1984 | Naik |
| 4,556,534 | A | 12/1985 | Burnett et al. |
| 4,556,607 | A | 12/1985 | Sastri |
| 4,569,824 | A | 2/1986 | Duhl |
| 4,585,620 | A | 4/1986 | Kamohara et al. |
| 4,795,504 | A | 1/1989 | Slaney et al. |
| 4,854,980 | A | 8/1989 | Raman et al. |
| 4,883,640 | A | 11/1989 | Mizuhara |
| 4,931,255 | A | 6/1990 | Doherty et al. |
| 4,981,644 | A | 1/1991 | Chang |
| 5,133,993 | A | 7/1992 | Streckert |
| 5,401,307 | A | 3/1995 | Czech et al. |

(Continued)

FOREIGN PATENT DOCUMENTS

JP 11310839 A * 11/1999

OTHER PUBLICATIONS

NPL: Machine translation of JP11310839A. Nov. 1999.*

(Continued)

*Primary Examiner* — Jie Yang
(74) *Attorney, Agent, or Firm* — Barnes & Thornburg LLP

(57) ABSTRACT

Nickel-base composite niobium bearing alloys including delta and/or eta strengthening phases in addition to gamma prime precipitates in a gamma matrix.

19 Claims, 9 Drawing Sheets

Alloy LN8

Alloy RCH48

(56) References Cited

U.S. PATENT DOCUMENTS

| | | | |
|---|---|---|---|
| 5,582,635 | A | 12/1996 | Czech et al. |
| 5,599,385 | A | 2/1997 | Czech et al. |
| 5,686,178 | A | 11/1997 | Stevens et al. |
| 5,786,785 | A | 7/1998 | Gindrup et al. |
| 5,866,273 | A | 2/1999 | Wiggins et al. |
| 5,892,476 | A | 4/1999 | Gindrup et al. |
| 6,017,628 | A | 1/2000 | Stevens et al. |
| 6,730,264 | B2 | 5/2004 | Cao |
| 6,797,401 | B2 | 9/2004 | Herron |
| 6,909,395 | B1 | 6/2005 | Carpenter |
| 7,060,241 | B2 | 6/2006 | Glatkowski |
| 7,192,537 | B2 | 3/2007 | Lucas |
| 7,247,368 | B1 | 7/2007 | Rogers |
| 7,345,616 | B2 | 3/2008 | Williams |
| 7,378,132 | B2 | 5/2008 | Renteria et al. |
| 7,491,275 | B2 | 2/2009 | Cao et al. |
| 7,531,054 | B2 | 5/2009 | Kennedy et al. |
| 7,612,138 | B2 | 11/2009 | Kuznetsov et al. |
| 7,633,424 | B1 | 12/2009 | Hill |
| 7,678,465 | B2 | 3/2010 | Sambasivan et al. |
| 8,031,104 | B2 | 10/2011 | Janis |
| 8,101,122 | B2 | 1/2012 | Hawk |
| 8,124,184 | B2 | 2/2012 | Sambasivan et al. |
| 8,147,749 | B2 | 4/2012 | Reynolds |
| 8,349,250 | B2 | 1/2013 | Suzuki et al. |
| 2003/0136478 | A1 | 7/2003 | Mitarai et al. |
| 2004/0005483 | A1 | 1/2004 | Lin |
| 2004/0011245 | A1 | 1/2004 | Sambasivan et al. |
| 2005/0047953 | A1 | 3/2005 | Hieber et al. |
| 2007/0065676 | A1 | 3/2007 | Bacalski et al. |
| 2009/0136381 | A1 | 5/2009 | Tin et al. |
| 2010/0038412 | A1 | 2/2010 | Huang |
| 2011/0200838 | A1 | 8/2011 | Thomas et al. |
| 2011/0203707 | A1 | 8/2011 | Mourer et al. |
| 2012/0027607 | A1 | 2/2012 | DiDomizio et al. |
| 2012/0267420 | A1 | 10/2012 | Cheney |
| 2013/0052077 | A1 | 2/2013 | Hardy |
| 2015/0167124 | A1* | 6/2015 | Helmink ..... C22C 19/007 420/445 |

OTHER PUBLICATIONS

NPL-1: Xie et al, Structure stability study on a newly developed nickel-base superalloy—Allvac 718plius, TMS (the minerals, metals & materials society, 2005. pp. 179-191.*

Xie, et al., "Strucutre Stability Study on a Newly Developed Nickel-Base Superalloy—AIIVAC 718PLUS", TMS (The Minerals, Metals & Materials Society), 2005.

Extended European Search Report, European Application No. 14180694.3-1362, dated Jan. 15, 2016, 6 pages.

Extended European Search Report for EP 14180694.3, dated Jan. 16, 2015.

* cited by examiner

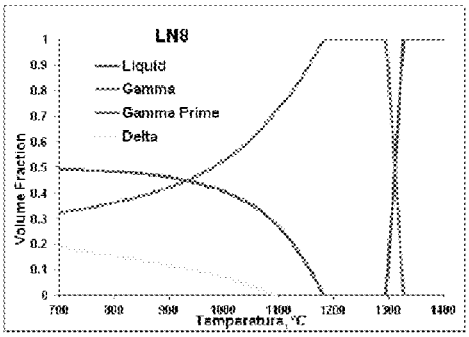
Figure 1A - Alloy LN8
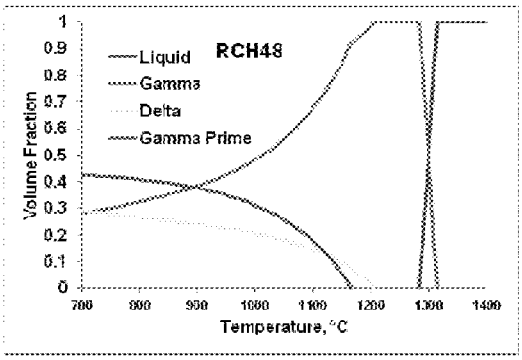
Figure 1B - Alloy RCH48
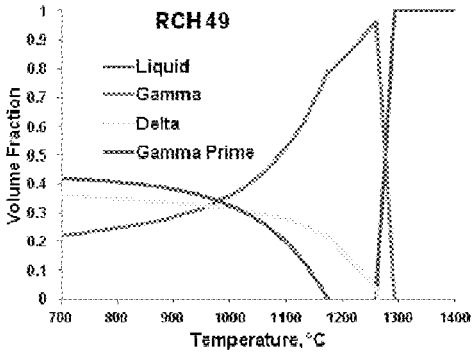
Figure 1C - Alloy RCH 49
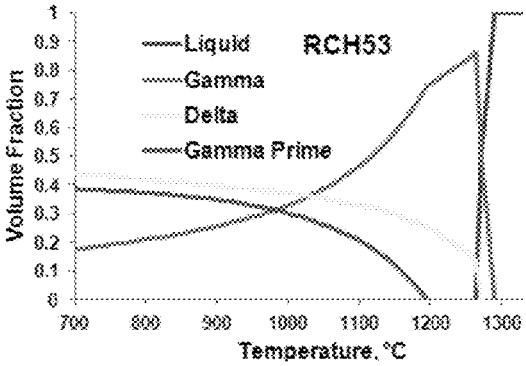
Figure 1D - Alloy RCH 53

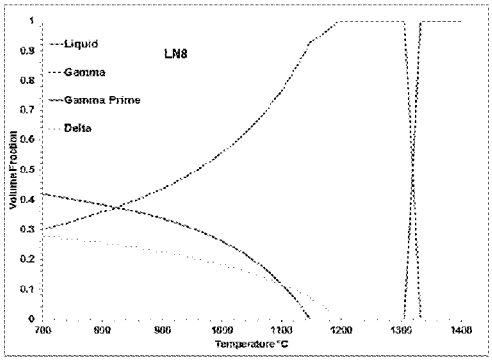
Figure 2A-Alloy LN8
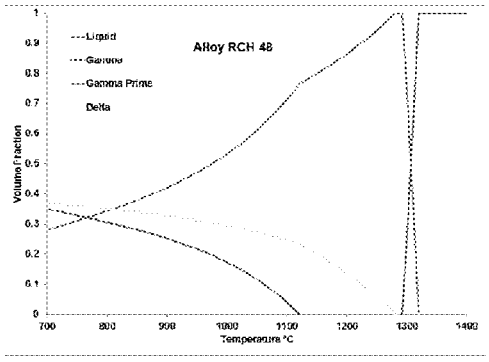
Figure 2B-Alloy RCH 48
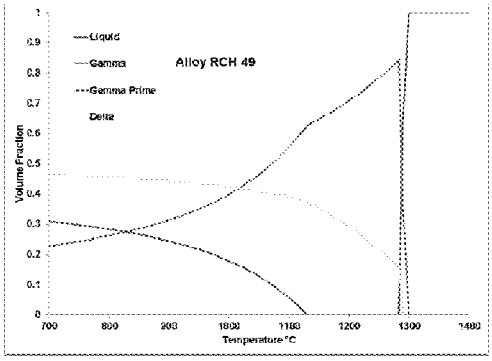
Figure 2C-Alloy RCH49
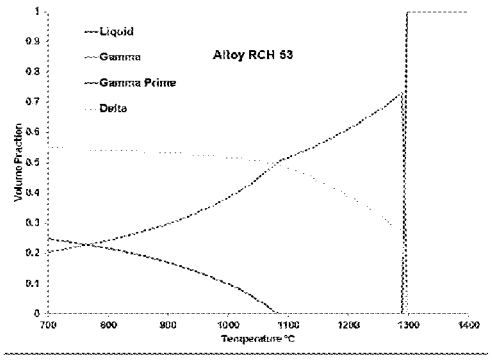
Figure 2D-Alloy RCH53
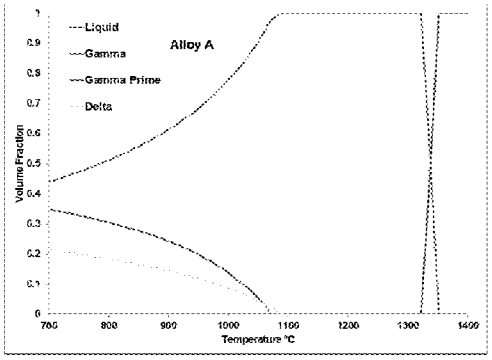
Figure 2E-Alloy A
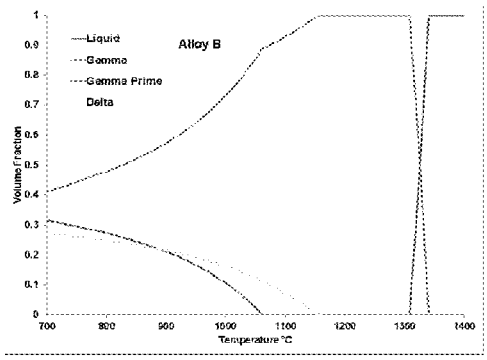
Figure 2F-Alloy B

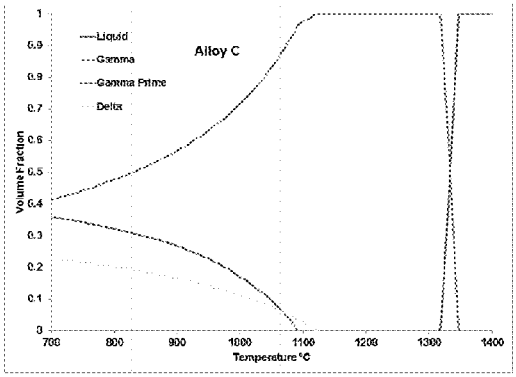
Figure 2G-Alloy C
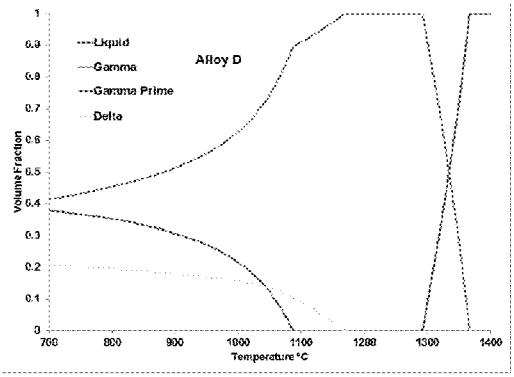
Figure 2H-Alloy D
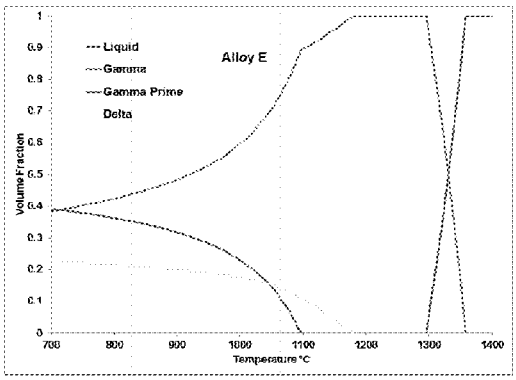
Figure 2I-Alloy E

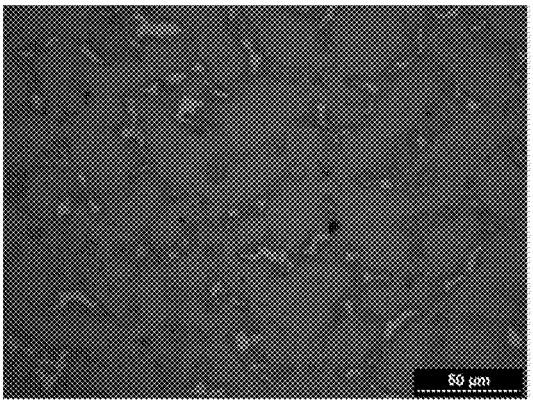
Figure 3A - Alloy LN8
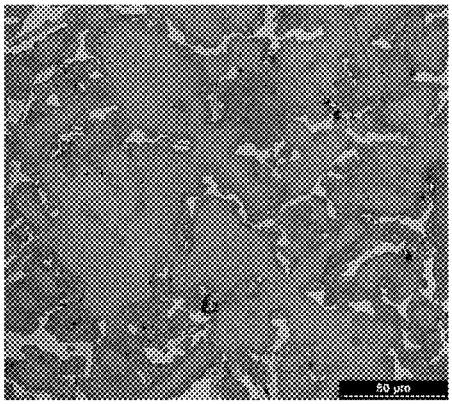
Figure 3B - Alloy RCH48
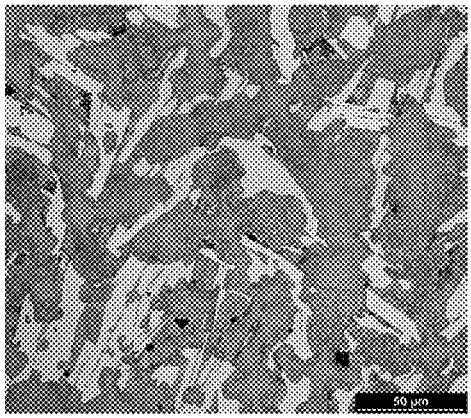
Figure 3C - Alloy RCH49
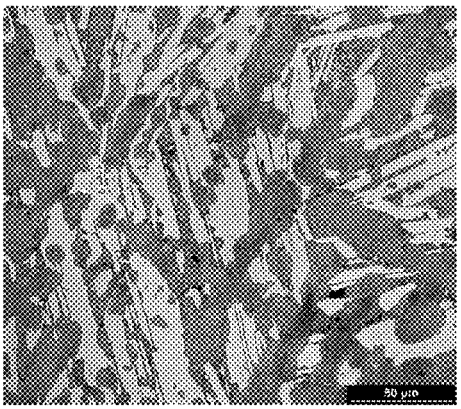
Figure 3D - Alloy RCH53

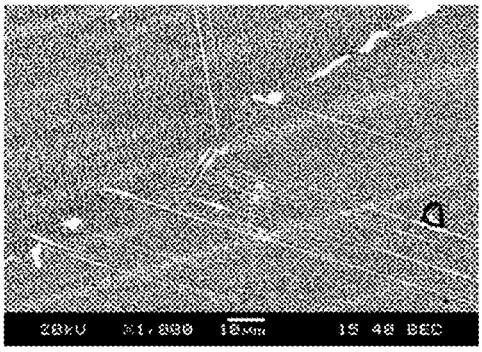
Figure 4A – Alloy A
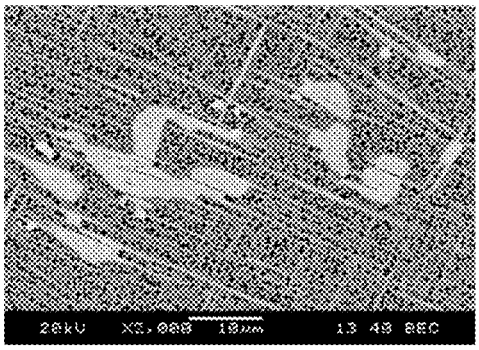
Figure 4B – Alloy B
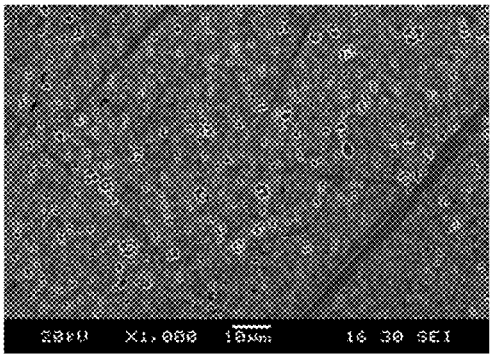
Figure 4C– Alloy C
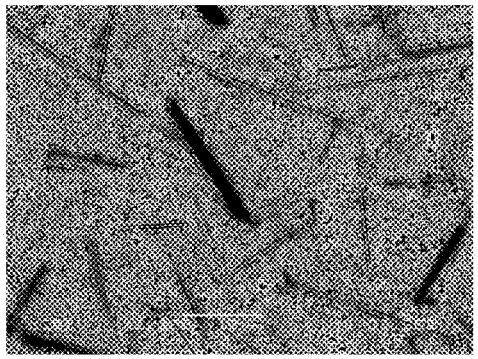
Figure 4D – Alloy D
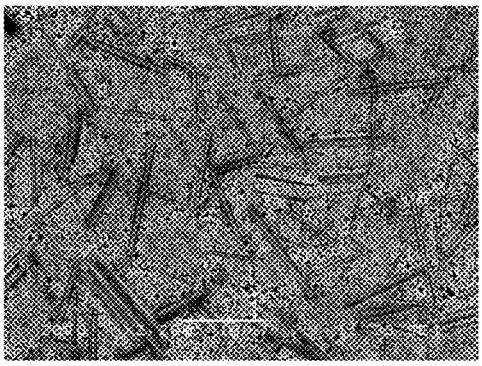
Figure 4E - Alloy E

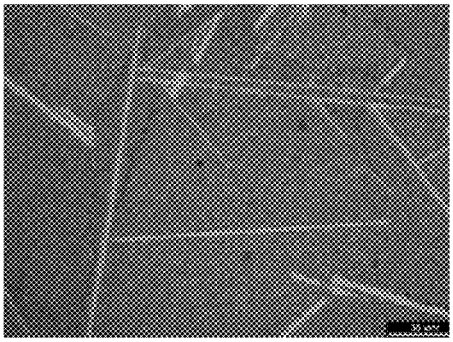
Figure 5A - Alloy LN8
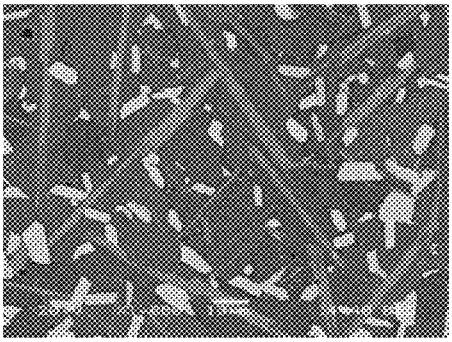
Figure 5B - Alloy RCH48
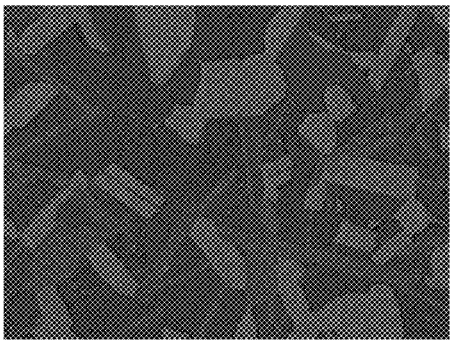
Figure 5C - Alloy RCH 49
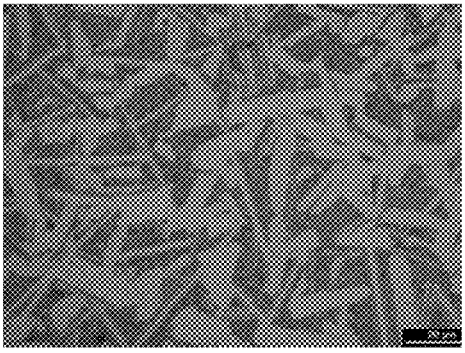
Figure 5D - Alloy RCH 53

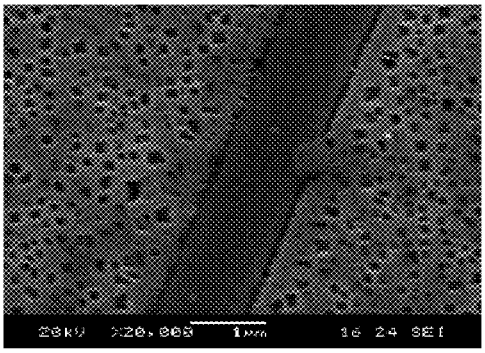
Figure 6A - Alloy LN8
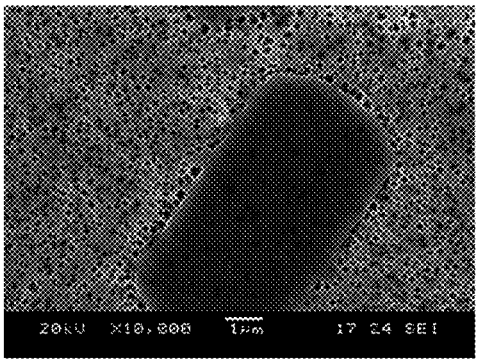
Figure 6B - Alloy RCH48
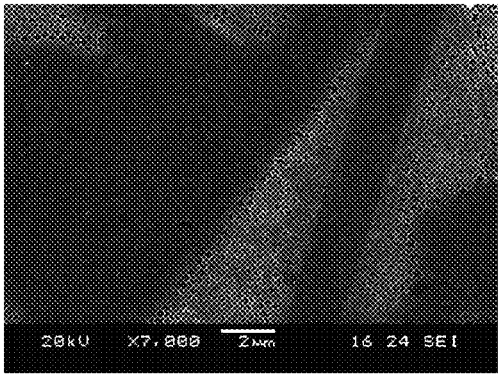
Figure 6C - Alloy RCH 49
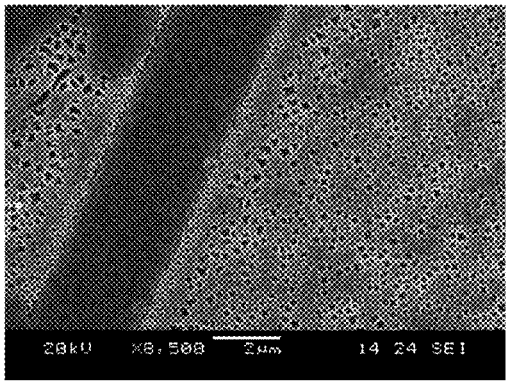
Figure 6D - Alloy RCH 53

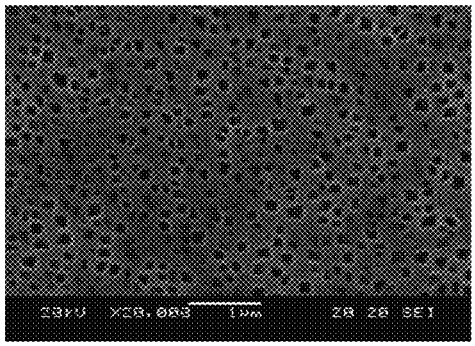
Figure 7A - Alloy LN8
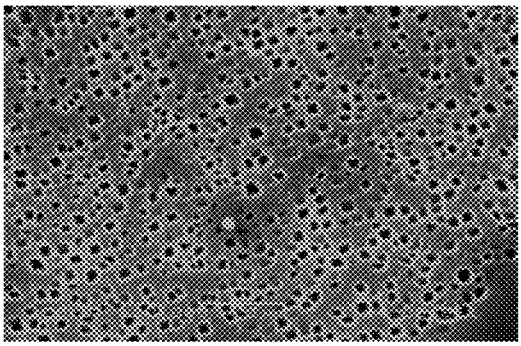
Figure 7B - Alloy RCH48
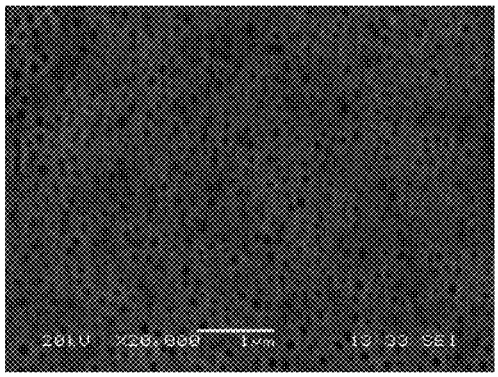
Figure 7C - Alloy RCH 49
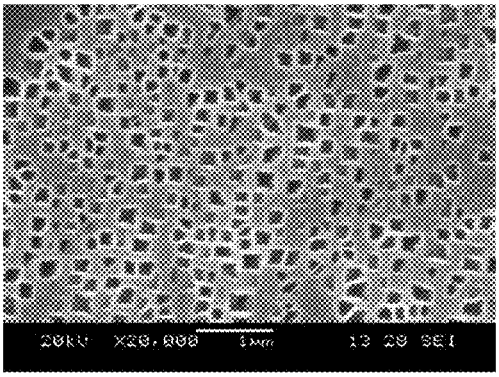
Figure 7D - Alloy RCH 53
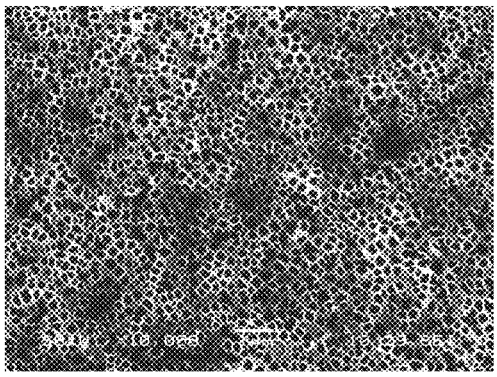
Figure 7E – Alloy D
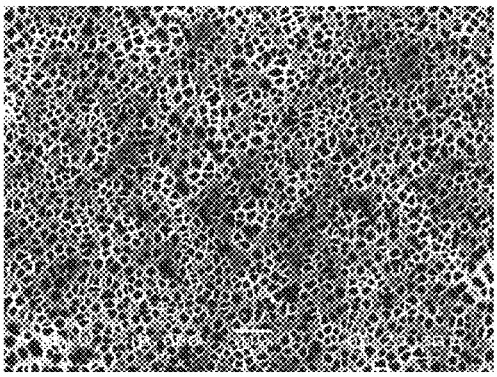
Figure 7F – Alloy E

COMPOSITE NIOBIUM-BEARING SUPERALLOYS

CROSS-REFERENCE TO RELATED APPLICATIONS

This application claims the benefit under 35 USC §119(e) of U.S. Provisional Application Ser. No. 61/865,181, filed on Aug. 13, 2013, the entire disclosure of which is incorporated herein by reference.

FIELD OF THE DISCLOSURE

The present disclosure relates generally to superalloys. More specifically, the present disclosure relates to nickel-base composite niobium-bearing superalloys having high strength and improved ductility at elevated temperatures.

BACKGROUND

There is a continuing need for alloys to enable disk rotors in gas turbine engines, such as those in the high pressure compressor and turbine, to operate at higher compressor outlet temperatures and faster shaft speeds. The higher temperatures and increased shaft speeds facilitate the high climb rates that are increasingly required by commercial airlines to move aircraft more quickly to altitude, to reduce fuel burn and to clear the busy air spaces around airports. These operating conditions give rise to fatigue cycles with long dwell periods at elevated temperatures, in which oxidation and time dependent deformation can significantly decrease resistance to low cycle fatigue. As a result, there is a need to improve the resistance of alloys to surface environmental damage and dwell fatigue crack growth, and to increase proof strength, without compromising their other mechanical and physical properties or increasing their density.

Conventional high pressure compressor disks and/or high pressure turbine disks of gas turbine engines are often produced from high strength nickel-base superalloys. These materials are often highly alloyed with refractory elements to enhance strength and precipitate a high volume fraction of gamma prime strengthening phase into the gamma phase. The grain structure of such alloys is typically designed to optimize strength and low cycle fatigue performance and/or resistance to fatigue crack growth and creep deformation by controlling heat treat parameters. Examples of in highly alloyed nickel-base superalloys are discussed in U.S. Pat. No. 6,132,527; U.S. Pat. No. 6,521,175; and U.S. Pat. No. 6,969,431. As the overall level of refractory alloying elements increases in such alloys, the microstructure can become thermodynamically unstable, such that microstructural changes occurring during operation can reduce mechanical properties of the alloys.

Future gas turbine engine components likely will be required to operate at higher temperatures and/or higher stresses than existing ones. Presently available nickel-base superalloys may be unable to meet these future operating requirements. Various alloys have emerged as potential candidates for future gas turbine engine turbine and/or compressor disks. Examples of such alloys, which typically employ third phase precipitation of delta or eta phase to enhance high temperature mechanical properties, are discussed in U.S. Patent Application Publication No. 2012/0027607 A1; U.S. Pat. No. 8,147,749; U.S. Patent Application Publication No. 2013/0052077 A1 and U.S. Patent Application Publication No. 2009/0136381 A1. However, the strength, stability or ductility of some of these materials may not be adequate for the high stresses and highly multi-axial stress states encountered by compressor and turbine disks in operation and the high tantalum content, a heavy and expensive element, in some of the alloys could adversely affect cost and density.

SUMMARY

The present application discloses one or more of the features recited in the appended claims and/or the following features which, alone or in any combination, may comprise patentable subject matter.

A composite niobium bearing alloy may consist of 2.2 to 4 wt. % aluminum, 0.01 to 0.05 wt. % boron, 0.02 to 0.06 wt. % carbon, 6 to 15 wt. % chromium, 0 to 20 wt. % cobalt, 0 to 0.5 wt. % hafnium, 1 to 3 wt. % molybdenum, 7.2 to 16 wt. % niobium, 0 to 0.6 wt % silicon, 1 to 5 wt. % tantalum, 0 to 2.5 wt. % titanium, 1 to 3 wt. % tungsten, 0.04 to 0.1 wt. % zirconium and the balance nickel and incidental impurities.

In some embodiments the composite niobium bearing alloy consists of 2.2 to 2.8 wt. % aluminum, 0.015 wt. % boron, 0.03 wt. % carbon, 6 to 8.6 wt. % chromium, 1.5 wt. % molybdenum, 8.5 to 15 wt. % niobium, 2.9 to 4.5 wt. % tantalum, 1.5 to 2.25 wt. % titanium, 1.5 wt. % tungsten, 0.05 wt. % zirconium and the balance nickel and incidental impurities.

In some embodiments the composite niobium bearing alloy consists of 2.8 wt. % aluminum, 0.15 wt. % boron, 0.03 wt. % carbon, 8.6 wt. % chromium, 1.5 wt. % molybdenum, 8.5 wt. % niobium, 4.5 wt. % tantalum, 1.6 wt. % titanium, 1.5 wt. % tungsten, 0.05 wt. % zirconium and the balance nickel and incidental impurities.

In some embodiments the composite niobium bearing alloy consists of 2.25 wt. % aluminum, 0.15 wt. % boron, 0.03 wt. % carbon, 8 wt. % chromium, 1.5 wt. % molybdenum, 10.5 wt. % niobium, 3 wt. % tantalum, 2.25 wt. % titanium, 1.5 wt. % tungsten, 0.05 wt. % zirconium and the balance nickel and incidental impurities.

In some embodiments the composite niobium bearing alloy consists of 2.25 wt. % aluminum, 0.15 wt. % boron, 0.03 wt. % carbon, 7.85 wt. % chromium, 1.5 wt. % molybdenum, 12.85 wt. % niobium, 3 wt. % tantalum, 2.25 wt. % titanium, 1.5 wt. % tungsten, 0.05 wt. % zirconium and the balance nickel and incidental impurities.

In some embodiments the composite niobium bearing alloy consists of 2.2 wt. % aluminum, 0.15 wt. % boron, 0.03 wt. % carbon, 6 wt. % chromium, 1.5 wt. % molybdenum, 15 wt. % niobium, 2.9 wt. % tantalum, 1.5 wt. % titanium, 1.5 wt. % tungsten, 0.05 wt. % zirconium and the balance nickel and incidental impurities.

In some embodiments the composite niobium bearing alloy includes globular or acicular delta phase, aluminum containing delta phase, and eta phase precipitates singularly or in combination, and gamma prime phase precipitates in the gamma phase.

In some embodiments the aluminum containing delta phase is $Ni_6AlNb$.

In some embodiments the delta, eta and/or aluminum containing delta phase is located at the gamma grain boundaries.

In some embodiments the delta, eta, and/or aluminum containing delta phase is located at the gamma grain boundaries and within the gamma grains.

A composite niobium bearing alloy may include about 7 wt. % to about 16 wt. % niobium.

In some embodiments the composite niobium bearing alloy includes globular or acicular delta phase, aluminum containing delta phase, and eta phase precipitates singularly or in combination, and gamma prime phase precipitates in the gamma phase.

In some embodiments the aluminum containing delta phase is $Ni_6AlNb$.

In some embodiments the delta, eta and/or aluminum containing delta phase is located at the gamma grain boundaries.

In some embodiments the delta, eta, and/or aluminum containing delta phase is located at the gamma grain boundaries and within the gamma grains.

In some embodiments the composite niobium bearing alloy includes a lamellar structure of gamma phase and delta phase, gamma prime phase precipitates in the gamma phase, and the volume percentage of delta phase is about 10% to about 40%.

In some embodiments the volume percentage of delta phase is about 2% to about 15%.

A composite niobium bearing alloy may include about 2.2 to 4 wt. % aluminum, about 0.01 to 0.05 wt. % boron, about 0.02 to 0.06 wt. % carbon, about 6 to 15 wt. % chromium, about 0 to 20 wt. % cobalt, about 0 to 0.5 wt. % hafnium, about 1 to 3 wt. % molybdenum, about 7.2 to 16 wt. % niobium, about 0 to 0.6 wt % silicon, about 1 to 5 wt. % tantalum, about 0 to 2.5 wt. % titanium, about 1 to 3 wt. % tungsten, about 0.04 to 0.1 wt. % zirconium and the balance nickel and incidental impurities.

In some embodiments the composite niobium bearing alloy includes about 2.2 to about 2.8 wt. % aluminum, about 0.15 wt. % boron, about 0.03 wt. % carbon, about 6 to about 8.6 wt. % chromium, about 1.5 wt. % molybdenum, about 7 to about 16 wt. % niobium, about 2.9 to about 4.5 wt. % tantalum, about 1.5 to about 2.25 wt. % titanium, about 1.5 wt. % tungsten, about 0.05 wt. % zirconium and the balance nickel and incidental impurities.

In some embodiments the composite niobium bearing alloy includes about 2.8 wt. % aluminum, about 0.15 wt. % boron, about 0.03 wt. % carbon, about 8.6 wt. % chromium, about 1.5 wt. % molybdenum, about 8.5 wt. % niobium, about 4.5 wt. % tantalum, about 1.6 wt. % titanium, about 1.5 wt. % tungsten, about 0.05 wt. % zirconium and the balance nickel and incidental impurities.

In some embodiments the composite niobium bearing alloy includes about 2.25 wt. % aluminum, about 0.15 wt. % boron, about 0.03 wt. % carbon, about 8 wt. % chromium, about 1.5 wt. % molybdenum, about 10.5 wt. % niobium, about 3 wt. % tantalum, about 2.25 wt. % titanium, about 1.5 wt. % tungsten, about 0.05 wt. % zirconium and the balance nickel and incidental impurities.

In some embodiments the composite niobium bearing alloy includes about 2.25 wt. % aluminum, about 0.15 wt. % boron, about 0.03 wt. % carbon, about 7.85 wt. % chromium, about 1.5 wt. % molybdenum, about 12.85 wt. % niobium, about 3 wt. % tantalum, about 2.25 wt. % titanium, about 1.5 wt. % tungsten, about 0.05 wt. % zirconium and the balance nickel and incidental impurities.

In some embodiments the composite niobium bearing alloy includes about 2.2 wt. % aluminum, about 0.15 wt. % boron, about 0.03 wt. % carbon, about 6 wt. % chromium, about 1.5 wt. % molybdenum, about 15 wt. % niobium, about 2.9 wt. % tantalum, about 1.5 wt. % titanium, about 1.5 wt. % tungsten, about 0.05 wt. % zirconium and the balance nickel and incidental impurities.

In some embodiments the composite niobium bearing alloy includes globular or acicular delta phase, aluminum containing delta phase, and eta phase precipitates singularly or in combination, and gamma prime phase precipitates in the gamma phase.

In some embodiments the aluminum containing delta phase is $Ni_6AlNb$.

In some embodiments the delta, eta and/or aluminum containing delta phase is located at the gamma grain boundaries.

In some embodiments the delta, eta, and/or aluminum containing delta phase is located at the gamma grain boundaries and within the gamma grains.

In some embodiments the composite niobium bearing alloy includes a lamellar structure of gamma phase and delta phase, gamma prime phase precipitates in the gamma phase, and the volume percentage of delta phase is about 10% to about 40%.

In some embodiments the volume percentage of delta phase is about 2% to about 15%.

The following numbered embodiments are contemplated and are non-limiting:

1. A composite niobium bearing alloy consisting of 2.2 to 4 wt. % aluminum, 0.01 to 0.05 wt. % boron, 0.02 to 0.06 wt. % carbon, 6 to 15 wt. % chromium, 0 to 20 wt. % cobalt, 0 to 0.5 wt. % hafnium, 1 to 3 wt. % molybdenum, 7.2 to 16 wt. % niobium, 0 to 0.6 wt % silicon, 1 to 5 wt. % tantalum, 0 to 2.5 wt. % titanium, 1 to 3 wt. % tungsten, 0.04 to 0.1 wt. % zirconium and the balance nickel and incidental impurities.

2. A composite niobium bearing alloy according to clause 1 consisting of 2.2 to 2.8 wt. % aluminum, 0.015 wt. % boron, 0.03 wt. % carbon, 6 to 8.6 wt. % chromium, 1.5 wt. % molybdenum, 8.5 to 15 wt. % niobium, 2.9 to 4.5 wt. % tantalum, 1.5 to 2.25 wt. % titanium, 1.5 wt. % tungsten, 0.05 wt. % zirconium and the balance nickel and incidental impurities.

3. A composite niobium bearing alloy according to clause 1 consisting of 2.8 wt. % aluminum, 0.15 wt. % boron, 0.03 wt. % carbon, 8.6 wt. % chromium, 1.5 wt. molybdenum, 8.5 wt. % niobium, 4.5 wt. % tantalum, 1.6 wt. % titanium, 1.5 wt. % tungsten, 0.05 wt. % zirconium and the balance nickel and incidental impurities.

4. A composite niobium bearing alloy according to clause 1 consisting of 2.25 wt. % aluminum, 0.15 wt. % boron, 0.03 wt. % carbon, 8 wt. % chromium, 1.5 wt. % molybdenum, 10.5 wt. % niobium, 3 wt. % tantalum, 2.25 wt. % titanium, 1.5 wt. % tungsten, 0.05 wt. % zirconium and the balance nickel and incidental impurities.

5. A composite niobium bearing alloy according to clause 1 consisting of 2.25 wt. % aluminum, 0.15 wt. % boron, 0.03 wt. % carbon, 7.85 wt. % chromium, 1.5 wt. % molybdenum, 12.85 wt. % niobium, 3 wt. % tantalum, 2.25 wt. % titanium, 1.5 wt. % tungsten, 0.05 wt. % zirconium and the balance nickel and incidental impurities.

6. A composite niobium bearing alloy according to clause 1 consisting of 2.2 wt. % aluminum, 0.15 wt. % boron, 0.03 wt. % carbon, 6 wt. % chromium, 1.5 wt. % molybdenum, 15 wt. % niobium, 2.9 wt. % tantalum, 1.5 wt. % titanium, 1.5 wt. % tungsten, 0.05 wt. % zirconium and the balance nickel and incidental impurities.

7. A composite niobium bearing alloy according to any one of clauses 1 to 6, including globular or acicular delta phase, aluminum containing delta phase, and eta phase precipitates singularly or in combination, and gamma prime phase precipitates in the gamma phase.

8. A composite niobium bearing alloy according to clause 7, wherein the aluminum containing delta phase is $Ni_6AlNb$.

9. A composite niobium bearing alloy according to clause 7 wherein the delta, eta and/or aluminum containing delta phase is located at the gamma grain boundaries.

10. A composite niobium bearing alloy according to clause 7 wherein the delta, eta, and/or aluminum containing delta phase is located at the gamma grain boundaries and within the gamma grains.

11. A composite niobium bearing alloy including about 7 wt. % to about 16 wt. % niobium.

12. A composite niobium bearing alloy according to clause 11, including globular or acicular delta phase, aluminum containing delta phase, and eta phase precipitates singularly or in combination, and gamma prime phase precipitates in the gamma phase.

13. A composite niobium bearing alloy according to clause 12, wherein the aluminum containing delta phase is $Ni_6AlNb$.

14. A composite niobium bearing alloy according to clause 12 wherein the delta, eta and/or aluminum containing delta phase is located at the gamma grain boundaries.

15. A composite niobium bearing alloy according to clause 12 wherein the delta, eta, and/or aluminum containing delta phase is located at the gamma grain boundaries and within the gamma grains.

16. A composite niobium bearing alloy according to any one of clauses 1 to 15, including a lamellar structure of gamma phase and delta phase, gamma prime phase precipitates in the gamma phase, and wherein the volume percentage of delta phase is about 10% to about 40%.

17. A composite niobium bearing alloy according to clause 16, wherein the volume percentage of delta phase is about 2% to about 15%.

18. A composite niobium bearing alloy including about 2.2 to 4 wt. % aluminum, about 0.01 to 0.05 wt. % boron, about 0.02 to 0.06 wt. % carbon, about 6 to 15 wt. % chromium, about 0 to 20 wt. % cobalt, about 0 to 0.5 wt. % hafnium, about 1 to 3 wt. % molybdenum, about 7.2 to 16 wt. % niobium, about 0 to 0.6 wt % silicon, about 1 to 5 wt. % tantalum, about 0 to 2.5 wt. % titanium, about 1 to 3 wt. % tungsten, about 0.04 to 0.1 wt. % zirconium and the balance nickel and incidental impurities.

19. A composite niobium bearing alloy according to clause 18 including about 2.2 to about 2.8 wt. % aluminum, about 0.15 wt. % boron, about 0.03 wt. % carbon, about 6 to about 8.6 wt. % chromium, about 1.5 wt. % molybdenum, about 7 to about 16 wt. % niobium, about 2.9 to about 4.5 wt. % tantalum, about 1.5 to about 2.25 wt. % titanium, about 1.5 wt. % tungsten, about 0.05 wt. % zirconium and the balance nickel and incidental impurities.

20. A composite niobium bearing alloy according to clause 18 including about 2.8 wt. % aluminum, about 0.15 wt. % boron, about 0.03 wt. % carbon, about 8.6 wt. % chromium, about 1.5 wt. % molybdenum, about 8.5 wt. % niobium, about 4.5 wt. % tantalum, about 1.6 wt. % titanium, about 1.5 wt. % tungsten, about 0.05 wt. % zirconium and the balance nickel and incidental impurities.

21. A composite niobium bearing alloy according to clause 18 including about 2.25 wt. % aluminum, about 0.15 wt. % boron, about 0.03 wt. % carbon, about 8 wt. % chromium, about 1.5 wt. % molybdenum, about 10.5 wt. % niobium, about 3 wt. % tantalum, about 2.25 wt. % titanium, about 1.5 wt. % tungsten, about 0.05 wt. % zirconium and the balance nickel and incidental impurities.

22. A composite niobium bearing alloy according to clause 18 including about 2.25 wt. % aluminum, about 0.15 wt. % boron, about 0.03 wt. % carbon, about 7.85 wt. % chromium, about 1.5 wt. % molybdenum, about 12.85 wt. % niobium, about 3 wt. % tantalum, about 2.25 wt. % titanium, about 1.5 wt. % tungsten, about 0.05 wt. % zirconium and the balance nickel and incidental impurities.

23. A composite niobium bearing alloy according to clause 18 including about 2.2 wt. % aluminum, about 0.15 wt. % boron, about 0.03 wt. % carbon, about 6 wt. % chromium, about 1.5 wt. % molybdenum, about 15 wt. % niobium, about 2.9 wt. % tantalum, about 1.5 wt. % titanium, about 1.5 wt. % tungsten, about 0.05 wt. % zirconium and the balance nickel and incidental impurities.

24. A composite niobium bearing alloy according to any one of clauses 18 to 23, including globular or acicular delta phase, aluminum containing delta phase, and eta phase precipitates singularly or in combination, and gamma prime phase precipitates in the gamma phase.

25. A niobium bearing alloy according to clause 24, wherein the aluminum containing delta phase is $Ni_6AlNb$.

26. A composite niobium bearing alloy according to clause 24 wherein the delta, eta and/or aluminum containing delta phase is located at the gamma grain boundaries.

27. A composite niobium bearing alloy according to clause 24 wherein the delta, eta, and/or aluminum containing delta phase is located at the gamma grain boundaries and within the gamma grains.

28. A composite niobium bearing alloy according to any one of clauses 18 to 23, including a lamellar structure of gamma phase and delta phase, gamma prime phase precipitates in the gamma phase, and wherein the volume percentage of delta phase is about 10% to about 40%.

29. A composite niobium bearing alloy according to clause 28, wherein the volume percentage of delta phase is about 2% to about 15%.

These and other features of the present disclosure will become more apparent from the following description of the illustrative embodiments.

BRIEF DESCRIPTION OF THE DRAWINGS

FIGS. 1A-1D are predicted phase equilibrium graphs of arc melted alloys using the 2012 thermodynamic database and solver according to certain embodiments of the present invention.

FIGS. 2A-2I are predicted phase equilibrium graphs of arc melted alloys using the 2013 thermodynamic database and solver according to certain embodiments of the present invention.

FIGS. 3A-3D are micrographs of arc melted alloys according to certain embodiments of the present invention.

FIGS. 4A-4E are scanning electron micrographs of heat treated arc melted or compacted powder alloys according to certain embodiments of the present invention.

FIGS. 5A-5D are scanning electron micrographs of heat treated compacted powder alloys according to certain embodiments of the present invention.

FIGS. 6A-6D are scanning electron micrographs of interfaces in heat treated compacted powder alloys according to certain embodiments of the present invention FIGS. 7A-7F are higher magnification scanning electron micrographs of gamma prime morphology in heat treated compacted powder alloys according to certain embodiments of the present invention

DETAILED DESCRIPTION

Figure 8:
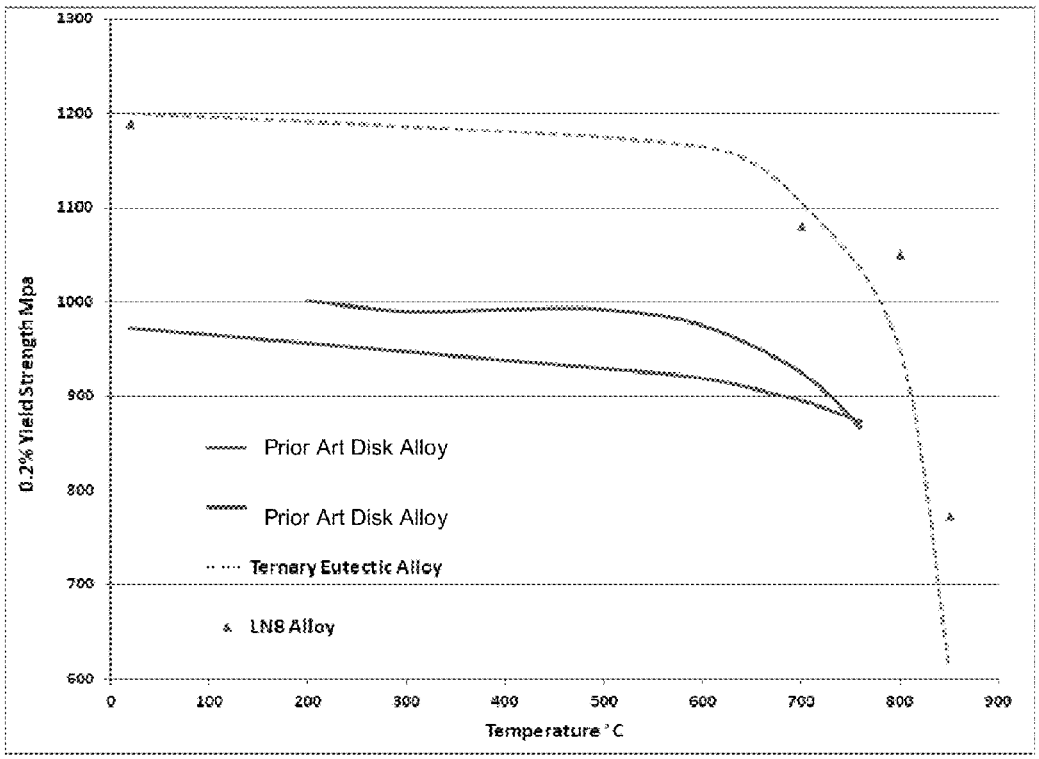
FIG. 8 shows the variation in yield strength with temperature for a heat treated compacted powder alloy according to an embodiment of the present invention compared with a number of prior art alloys.

For the purposes of promoting an understanding of the principles of the disclosure, reference will now be made to a number of illustrative embodiments illustrated in the drawings and specific language will be used to describe the same.

The present invention relates to a class of nickel-base superalloys with composite strengthening from delta and/or eta phases in addition to gamma prime particulate strengthening in a gamma matrix. These alloys can operate at higher temperatures with improved stability and ductility as compared to known alloys and are intended to operate for prolonged periods of time at high stresses and temperatures up to at least about 825° C.

Alloys of the invention include niobium-bearing gamma-gamma prime-delta (γ-γ'-δ) or gamma-gamma prime-eta (γ-γ'-η) superalloys. Microstructures of these composite niobium bearing alloys typically consist of (1) globular or acicular particles of delta, an aluminum containing delta phase, and/or eta phase precipitates singularly or in combination and (2) gamma prime phase precipitates in the gamma phase.

The gamma prime, delta phases, and eta phases are ordered intermetallic phases of composition $Ni_3X$, where X can be aluminum, niobium, titanium or tantalum. Gamma prime is a ductile phase with a face centered cubic structure. The composition of the gamma prime phase is typically $Ni_3Al$ and it is the primary strengthening precipitate. However, depending on the composition of the alloy, other elements, such as titanium, tantalum and niobium, may substitute for the Al atoms. The gamma prime phase is typically spherical or cubic, but degenerate shapes can occur in larger particles.

The delta phase has an orthorhombic structure and limited ductility. The composition of the delta phase is typically $Ni_3Nb$. Depending on the composition of the alloy, titanium and tantalum and may substitute for the Nb atoms and, under certain conditions, Al may substitute for the Nb atoms to form $Ni_6AlNb$ with a hexagonal structure. The delta phase may be irregularly shaped globular particles or highly acicular needles or lamellae.

The eta phase has a hexagonal structure and the composition of the eta phase is typically $Ni_3Ti$. However, aluminum, tantalum and niobium may substitute for titanium. The eta phase is generally acicular, but the aspect ratio of the phase can vary considerably. The matrix gamma phase is disordered face centered cubic.

Alloys of the present invention may contain a number of other elements in addition to Ni, Nb, Ti, Ta and Al. The addition of chromium increases resistance to oxidation and corrosion. Chromium preferentially partitions to the matrix gamma phase. However, the amount of Cr should be limited to no more than about 15 wt. % due to its propensity to combine with refractory elements in the alloy and form topologically close-packed (TCP) phases like sigma and, preferably, to no more than about 9 wt. % for the 10%-40% delta plus eta phase variants which contain correspondingly less matrix gamma phase fraction. These TCP phases are embrittling and are therefore generally undesirable. Cobalt generally lowers the gamma prime solvus and the stacking fault energy which aids processability, creep rupture strength, and, at some temperatures, fatigue strength. However, Co can also aid formation of TCP phases and should therefore be limited to not more than about 20 wt. %. Molybdenum and tungsten are solid solution strengtheners for both the gamma and gamma prime phases. Boron, carbon, and zirconium may be added to strengthen the grain boundaries by forming nonmetallic particles at the grain boundaries. The elements can also counteract the deleterious effects of grain impurity segregates like sulfur and oxygen by acting as a diffusion barrier. Hafnium and silicon may be used to improve dwell fatigue and environmental resistance, respectively. In general, all the metallic phases exhibit some degree of solubility for the other alloying elements in the material.

Alloys of the present invention have lower niobium content than traditional ternary eutectic gamma-gamma prime-delta alloys and higher niobium content than typical nickel-base superalloys. In certain embodiments, alloys of the present invention have niobium levels of about 7 weight % to about 16 weight %. Four alloys with varying niobium content were selected for examination and hot compacted powder specimens were produced. The nominal compositions of the four alloys are shown in Table 1. The compositions were selected in an attempt to produce gamma-gamma prime-delta/eta alloys with lower volume fractions of the delta and eta phases, which can adversely affect ductility. In certain embodiments of the invention, the volume percentage of the delta and eta phases is about 10% to about 40%. In other embodiments of the invention, the volume percentage of the delta and eta phases is about 2% to about 15%. The alloys have substantial quantities of multiple strengthening ordered precipitates and sufficient matrix phase for ductility, while avoiding undesirable topologically close-packed phases.

TABLE 1

| Alloy | Al | B | C | Cr | Mo | Nb | Ta | Ti | W | Zr | Ni |
|---|---|---|---|---|---|---|---|---|---|---|---|
| LN8 | 2.8 | .015 | .03 | 8.6 | 1.5 | 8.5 | 4.5 | 1.6 | 1.5 | .05 | Balance |
| RCH48 | 2.25 | .015 | .03 | 8 | 1.5 | 10.5 | 3 | 2.25 | 1.5 | .05 | Balance |
| RCH49 | 2.25 | .015 | .03 | 7.85 | 1.5 | 12.85 | 3 | 2.25 | 1.5 | .05 | Balance |
| RCH53 | 2.2 | .015 | .03 | 6 | 1.5 | 15 | 2.9 | 1.5 | 1.5 | .05 | Balance |

Five additional alloys with varying niobium content were selected for examination and hot compacted powder specimens were produced. The nominal compositions of the five alloys are shown in Table 2. These alloys primarily explored compositional interactions towards the lower end of the delta plus eta phase range.

TABLE 2

| Alloy | Al | Co | Cr | Mo | Nb | Ta | Ti | W | Ni |
|---|---|---|---|---|---|---|---|---|---|
| A | 2.9 | — | 10.3 | 1.6 | 7.7 | 4.5 | — | 1.5 | Balance |
| B | 2.7 | — | 10.3 | 1.6 | 9.2 | 4.5 | — | 1.5 | Balance |
| C | 2.9 | — | 10.3 | 1.6 | 7.7 | 4.5 | .4 | 1.5 | Balance |
| D | 3.4 | 17.7 | 12.2 | 2.4 | 8.5 | 3 | — | 2.4 | Balance |
| E | 3.4 | 12 | 12.2 | 2.4 | 8.5 | 3 | — | 2.4 | |

FIGS. 1A-1D show predicted phase equilibrium for the gamma, gamma prime and delta phases versus temperature for arc melted samples of the alloys of Table 1 (minus carbon, boron, and zirconium) using the 2012 thermodynamic nickel database and solver software package. Increasing the niobium concentration dramatically increases the delta solvus temperature and the delta phase fraction.

FIGS. 2A-2I show predicted phase equilibrium for the gamma, gamma prime and delta phases versus temperature for arc melted samples of the alloys of Table 1 and Table 2 using the 2013 thermodynamic nickel database and solver software package. The 2013 software shows the same trend of increase delta solvus temperature and delta phase fraction with increasing niobium concentration, and demonstrates greater delta stability versus the gamma and gamma prime phases for all the compositions.

FIGS. 3A-3D show the microstructures of arc melted samples of the alloys of Table 1 in the as-cast condition. The dark gray regions in FIGS. 3A-3D are the eutectic region and the light gray regions are the delta phase. The black regions are shrinkage porosity.

FIGS. 4A-4E show the microstructures of compacted powder alloys from Table 2 after solution heat treatment and high temperature isothermal exposuress. The materials were solution heat treated at 1140° C. to 1230° C. and isothermally held at 1100° C. to 1110° C. for 4 to 8 hours. The small black speroidal particles are gamma prime within the light gray gamma phase. The lighter globular particles are delta and the more acicular phases are delta and eta, which can be light or dark.

FIGS. 5A-5D show the microstructures of compacted powder alloys from Table 1 after solution and aging heat treatments. The materials were solution heat treated at 1195° C. to 1215° C., controlled cooled from the solution temperature at 1° C. per second to simulate typical cooling conditions in large turbine engine disks, and aged at 850° C. for 16 hours. The darker gray material is the gamma phase with small gamma prime precipitates within the gamma phase. The lighter globular particles are delta and the more acicular phases are delta and eta.

FIGS. 6A-6D illustrate the interfaces of the delta and eta phases of the compacted powder alloys from Table 1 after solution and aging heat treatments. The smaller particles are gamma prime and the larger particles are delta or eta. The roughened interfaces of the delta and eta particles aid load transfer and thereby increase the strengthening effect of these particles.

FIGS. 7A-7F are higher magnification scanning electron micrographs of the microstructures of the compacted powder alloys from Table 1, and alloys D and E from Table 2, after solution and aging heat treatments and show the gamma prime morphology. In spite of the slow cooling rates employed from the solution heat treat temperature and the high aging temperature employed to increase alloy stability, the gamma prime size remained quite small. In many conventional superalloys such treatments would produce gamma prime particles more than twice as large as those observed in these alloys. However, alloys of the present invention resist diffusion to a degree that prevents formation of such large particles.

FIG. 8 shows the variation in yield strength with temperature for one of the compacted powder alloys from Table 1 after solution and aging heat treatments compared with a number of prior art alloys. As shown in FIG. 8, the strength retention versus temperature for the embodiment of the alloy of the invention is equivalent or superior to the prior art alloys.

Alloys of the present invention may be manufactured in a number of ways. For example, the alloys may be manufactured using powder metallurgy typically used to produce high strength, high temperature disk alloys. Powder metallurgy manufacturing in conjunction with thermo-mechanically working the forging stock may refine the delta structure, thereby improving its ability to limit grain growth of the gamma phase. Cast and wrought processing techniques can also be used.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A composite niobium bearing alloy consisting of 2.2 to 4 wt. % aluminum, 0.01 to 0.05 wt. % boron, 0.02 to 0.06 wt. % carbon, 6 to 15 wt. % chromium, 0 to 20 wt. % cobalt, 0 to 0.5 wt. % hafnium, 1 to 3 wt. % molybdenum, 8.5 to 15 wt. % niobium, 0 to 0.6 wt % silicon, 1 to 5 wt. % tantalum, 0 to 2.5 wt. % titanium, 1 to 3 wt. % tungsten, 0.04 to 0.1 wt. % zirconium and the balance nickel and incidental impurities, wherein the alloy includes globular or acicular delta phase, aluminum containing delta phase, and eta phase precipitates singularly or in combination, and gamma prime phase precipitates in the gamma phase, including a lamellar structure of gamma phase and delta phase, gamma prime phase precipitates in the gamma phase, and wherein the volume percentage of delta phase and eta phase is about 2% to about 40%.

2. The composite niobium bearing alloy according to claim 1 consisting of 2.2 to 2.8 wt. % aluminum, 0.015 wt. % boron, 0.03 wt. % carbon, 6 to 8.6 wt. % chromium, 1.5 wt. % molybdenum, 2.9 to 4.5 wt. % tantalum, 1.5 to 2.25 wt. % titanium, 1.5 wt. % tungsten, 0.05 wt. % zirconium and the balance nickel and incidental impurities.

3. The composite niobium bearing alloy according to claim 1, wherein the aluminum containing delta phase is $Ni_6AlNb$.

4. The composite niobium bearing alloy according to claim 1, wherein the delta, eta and/or aluminum containing delta phase is located at the gamma grain boundaries.

5. The composite niobium bearing alloy according to claim 1, wherein the delta, eta, and/or aluminum containing delta phase is located at the gamma grain boundaries and within the gamma grains.

6. The composite niobium bearing alloy according to claim 1, including a lamellar structure of gamma phase and delta phase, gamma prime phase precipitates in the gamma phase, and wherein the volume percentage of delta phase and eta phase is about 10% to about 40%.

7. A composite niobium bearing alloy including about 2.2 to 4 wt. % aluminum, about 0.01 to 0.05 wt. % boron, about 0.02 to 0.06 wt. % carbon, about 6 to 15 wt. % chromium, about 0 to 20 wt. % cobalt, about 0 to 0.5 wt. % hafnium, about 1 to 3 wt. % molybdenum, about 8.5 to 15 wt. % niobium, about 0 to 0.6 wt % silicon, about 1 to 5 wt. % tantalum, about 0 to 2.5 wt. % titanium, about 1 to 3 wt. % tungsten, about 0.04 to 0.1 wt. % zirconium and the balance nickel and incidental impurities, wherein the alloy includes globular or acicular delta phase, aluminum containing delta phase, and eta phase precipitates singularly or in combination, and gamma prime phase precipitates in the gamma phase, including a lamellar structure of gamma phase and delta phase, gamma prime phase precipitates in the gamma phase, and wherein the volume percentage of delta phase and eta phase is about 2% to about 40%.

8. The composite niobium bearing alloy according to claim 7 including about 2.2 to about 2.8 wt. % aluminum, about 0.15 wt. % boron, about 0.03 wt. % carbon, about 6 to about 8.6 wt. % chromium, about 1.5 wt. % molybdenum, about 2.9 to about 4.5 wt. % tantalum, about 1.5 to about 2.25 wt. % titanium, about 1.5 wt. % tungsten, about 0.05 wt. % zirconium and the balance nickel and incidental impurities.

9. The composite niobium bearing alloy according to claim 7 including about 2.8 wt. % aluminum, about 0.15 wt. % boron, about 0.03 wt. % carbon, about 8.6 wt. % chromium, about 1.5 wt. % molybdenum, about 8.5 wt. % niobium, about 4.5 wt. % tantalum, about 1.6 wt. % titanium, about 1.5 wt. % tungsten, about 0.05 wt. % zirconium and the balance nickel and incidental impurities.

10. The composite niobium bearing alloy according to claim 7 including about 2.25 wt. % aluminum, about 0.15 wt. % boron, about 0.03 wt. % carbon, about 8 wt. % chromium, about 1.5 wt. % molybdenum, about 10.5 wt. % niobium, about 3 wt. % tantalum, about 2.25 wt. % titanium, about 1.5 wt. % tungsten, about 0.05 wt. % zirconium and the balance nickel and incidental impurities.

11. The composite niobium bearing alloy according to claim 7 including about 2.25 wt. % aluminum, about 0.15 wt. % boron, about 0.03 wt. % carbon, about 7.85 wt. % chromium, about 1.5 wt. % molybdenum, about 12.85 wt. % niobium, about 3 wt. % tantalum, about 2.25 wt. % titanium, about 1.5 wt. % tungsten, about 0.05 wt. % zirconium and the balance nickel and incidental impurities.

12. The composite niobium bearing alloy according to claim 7 including about 2.2 wt. % aluminum, about 0.15 wt. % boron, about 0.03 wt. % carbon, about 6 wt. % chromium, about 1.5 wt. % molybdenum, about 15 wt. % niobium, about 2.9 wt. % tantalum, about 1.5 wt. % titanium, about 1.5 wt. % tungsten, about 0.05 wt. % zirconium and the balance nickel and incidental impurities.

13. The composite niobium bearing alloy according to claim 7 wherein the delta, eta and/or aluminum containing delta phase is located at the gamma grain boundaries.

14. The composite niobium bearing alloy according to claim 7, including a lamellar structure of gamma phase and delta phase, gamma prime phase precipitates in the gamma phase, and wherein the volume percentage of delta phase and eta phase is about 10% to about 40%.

15. The composite niobium bearing alloy of claim 7, wherein niobium is present at about 8.5 wt. %.

16. The composite niobium bearing alloy of claim 7, wherein niobium is present at about 9.2 wt. %.

17. The composite niobium bearing alloy of claim 7, wherein niobium is present at about 10.5 wt. %.

18. The composite niobium bearing alloy of claim 7, wherein niobium is present at about 12.85 wt. %.

19. The composite niobium bearing alloy of claim 7, wherein niobium is present at about 15 wt. %.

* * * * *